United States Patent [19]

Zemke et al.

[11] 4,421,435

[45] Dec. 20, 1983

[54] METHOD AND APPARATUS FOR APPLYING A THIN LIQUID FILM TO A VIBRATORY PLATE

[75] Inventors: Wayne P. Zemke, Port Washington; Clyde M. Maki, Hartford; Brian J. Smith, Port Washington, all of Wis.

[73] Assignee: Koehring Company, Brookfield, Wis.

[21] Appl. No.: 244,625

[22] Filed: Mar. 17, 1981

[51] Int. Cl.[3] ..... E01C 19/38

[52] U.S. Cl. ..... 404/113; 404/129

[58] Field of Search ..... 404/129, 111, 110, 108, 404/113, 133, 114

[56] References Cited

U.S. PATENT DOCUMENTS

| | | | |
|---|---|---|---|
| 2,830,511 | 4/1958 | Wills | 404/129 X |
| 2,909,970 | 10/1959 | Jackson | 404/113 |
| 3,246,584 | 4/1966 | Lee | 404/110 |
| 3,675,546 | 7/1972 | Smith | 404/129 |
| 4,040,762 | 8/1977 | Nilsson | 404/129 |
| 4,113,403 | 9/1978 | Tertinek | 404/113 |

*Primary Examiner*—Nile C. Byers, Jr.

*Attorney, Agent, or Firm*—Burns, Doane, Swecker & Mathis

[57] ABSTRACT

The present invention relates to a method and apparatus for applying a thin film of a liquid to a vibratory plate arranged on an edge of a vibratory compactor. The apparatus for applying the thin film of liquid includes a container assembly for holding the liquid adjacent the plate. Liquid is preferably supplied to the container assembly under the influence of gravity. An element for maintaining intimate contact between a thin liquid film and a front surface of the plate as the thin film moves downwardly along the plate surface is arranged within a lower portion of the container assembly. The element is arranged adjacent to an outlet from the container provided along substantially the entire width of the front plate. The thin liquid film flows from the container as a low velocity laminar flow along the surface of the plate in the form of a liquid sheet. The liquid remains in contact with the plate surface due primarily to surface tension as the liquid moves downwardly.

1 Claim, 3 Drawing Figures

METHOD AND APPARATUS FOR APPLYING A THIN LIQUID FILM TO A VIBRATORY PLATE

BACKGROUND AND SUMMARY OF THE PRESENT INVENTION

The present invention relates to a method and apparatus for applying a thin film of a liquid to a vibratory plate of a vibratory compactor. More particularly, the present invention relates to a method and apparatus that applies a thin film of liquid to the underside of an inclined plate of a compactor and maintains the film in contact with the plate until the film reaches a generally flat lower plate. The film of liquid prevents the material being compacted from sticking to the plate.

Compactors of the type having an inclined plate arranged at a forward and/or rearward edge of a flat vibratory plate are known. Such compactors are useful to pack soil or asphalt. However, particularly when the compactor is utilized with hot asphalt, the material being compacted tends to stick to the plates during operation. The material buildup necessitates periodic cessation of the compacting operation to clean the vibratory plates and allow efficient operation. Failure to clean the plates results in material buildup thereon which, in turn, causes an uneven finish to occur on the surface being compacted. Also, the additional material appreciably increases the weight of the plates and hence the moving mass increases causing an excess load on a motor driving the plates. Therefore, an economical and efficient method and apparatus are desirable to apply a liquid, preferably water, to the vibratory plates to prevent the material from sticking to the plates. The liquid prevents sticking by cooling the plate and/or by forming a liquid interface which does not mix, i.e., is immiscible, with the material being compacted.

One known apparatus which attempts to apply water to the vibratory plate of a compactor consists of an elongated tube arranged along a front surface of the inclined plate with a plurality of holes being provided along a longitudinal axis of the tube. Water is fed to a central location in the tube and dispersed through the holes along the length of the tube. However, a device of this type fails to apply a sufficient quantity of water to the bottom plate where the greatest portion of sticking occurs. Due to the violent action of the vibratory plate, the water emanating from the plurality of holes in the tube tends to be flung about in all directions. Consequently, a device of this type deposits as much water on the engine and the remainder of the compactor as is deposited where the water is needed on the plate or the material being compacted.

Another known device is used to wet a tire of a road roller to prevent material from adhering to the tire. The device includes an arcuate carrier arranged above the tire surface. Attached to a lower face of the carrier is a wiping element in the form of a coco-mat. Arranged above the coco-mat is a perforated spray pipe which directs water onto the coco-mat. However, a device of this type relies partially upon relative movement of the tire surface while in contact with the coco-mat in order to wipe the tire clean. Such a device is disclosed in U.S. Pat. No. 2,197,183 issued Apr. 16, 1940 to Keeler.

A device for distributing water to a road roller is also known that includes a vulcanized rubber mat arranged adjacent to the roller surface and connected to a holder which supports a sprinkler or spray tube. The object of the device is to prevent material from adhering to the roller surface. A device of this type also relies upon relative movement of the roller past the rubber mat to clean the surface. Such a device is disclosed in U.S. Pat. No. 4,040,762 issued Aug. 6, 1977 to Nilsson.

A free flowing water system for a roller of an asphalt rolling machine is also known. The water system is mounted adjacent to a front face of the roller and includes a water trough comprised of a vertical flange and a horizontal flange. A rubber blade provided on the base of the trough contacts the surface of the roller. In operation, water contained in the trough is dispensed to the surface of the roller by the rubber blade to prevent asphalt build-up on the roller. A device of this type as, for example, disclosed in U.S. Pat. No. 3,675,546 issued July 11, 1972 to Smith, does not establish a sheet of water moving uniformly downwardly along the surface of the roller.

Other water dispensing or roller wetting apparatus are disclosed in U.S. Pat. Nos. 1,722,907 issued July 30, 1929 to Liddle; 2,134,883 issued Nov. 1, 1938 to Moore, Jr.; 3,109,354 issued Nov. 5, 1963 to VanKirk; 3,308,729 issued Mar. 14, 1967 to Kestel; 3,814,553 issued June 4, 1974 to Buck; 3,986,782 issued Oct. 19, 1976 to Durham; and 4,009,967 issued Mar. 1, 1977 to Layton.

The known devices have several disadvantages. None of these devices is arranged to apply a thin liquid film to a violently vibrating, inclined plate in such a way that the liquid film remains in contact with the plate. The prior arrangements for applying water to the vibratory plates of a compactor waste large quantities of water since the water is flung about in all directions by the violent cycloidal motion action of the plates, where accelerations of $\pm 300$ g are not uncommon.

Many objects and advantages of the present invention will be apparent to those skilled in the art from the following specification which relates to a method and apparatus for applying a thin film of a liquid to a front surface of a vibratory inclined plate of a vibratory compactor. The apparatus includes a container assembly fixed to the front surface of the inclined plate for holding a quantity of the liquid. An inlet is provided for admitting the liquid substantially uniformly to the container assembly. An element maintains intimate contact between a thin liquid film and the surface of the inclined vibratory plate of the compactor. In addition, the element reduces the flow velocity in the thin films as it starts to move downwardly by gravity and compactor acceleration along a portion of the plate within the container assembly. A thin outlet gap along substantially the entire width of the inclined plate permits the thin liquid film to flow from the container assembly as a low velocity laminar flow along the front surface of the plate in the form of a liquid sheet which remains in contact with the plate surface primarily due to surface tension.

In the preferred embodiment, the container assembly includes an elongated sheet member selectively secured generally parallel to and spaced from the surface of the inclined plate. The inlet is formed by an elongated tube having a plurality of spaced perforations along a longitudinal axis of the tube with the tube being secured to the elongated sheet member to form an upper side of the container assembly. The sheet member is preferably secured to the inclined plate by a plurality of bolts and held in spaced relation from the front surface of the plate by a plurality of spacer washers arranged between the elongated sheet member and the inclined plate. The outlet is arranged as a narrow gap formed between an edge of the elongated sheet member and the plate surface.

Further, in the preferred embodiment, the element that maintains intimate contact in open cell urethane foam rubber arranged adjacent to both the plate surface and the outlet. In a second embodiment of the present invention, the element is a serrated rubber mat arranged adjacent the inclined plate surface and a small section of foam arranged beneath the rubber mat and adjacent to the outlet of the container assembly.

The method of applying a thin film of liquid to a vibratory plate of a vibratory compactor according to the present invention includes the steps of supplying a liquid to a container assembly arranged adjacent the vibratory plate. Intimate contact is maintained between a thin liquid film and the vibratory plate surface over at least a minimum downward distance along the surface within the container assembly. The thin film is then allowed to flow downwardly from the container assembly by gravity and plate acceleration as a low velocity laminar flow along substantially the entire width of the vibratory plate in the form of a liquid sheet which remains in contact with the surface due primarily to surface tension.

BRIEF DESCRIPTION OF THE DRAWINGS

Preferred embodiments of the present invention will be described with reference to the accompanying drawings wherein like members bear like reference numerals and wherein.

DETAILED DESCRIPTION OF THE PREFERRED EMBODIMENTS

Figure 1:
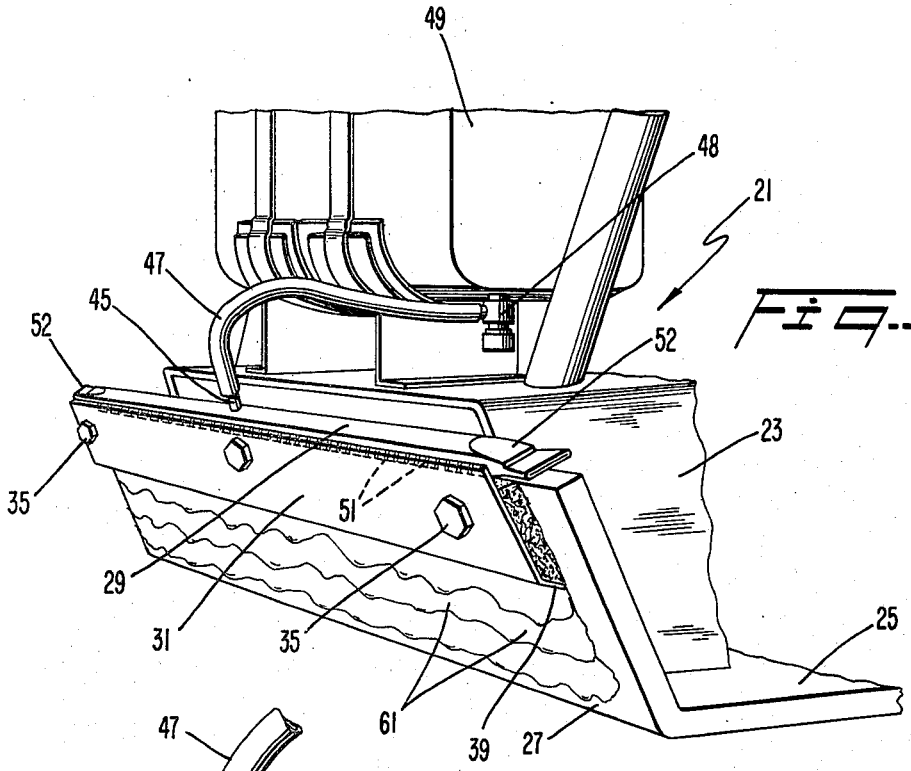
FIG. 1 is a perspective view of a portion of a vibrator compactor having an apparatus according to the present invention attached to an inclined plate of the compactor.

With reference to FIG. 1, a vibratory compactor 21 (only partially shown) includes a frame 23 which supports a prime mover (not shown) and other features typically provided on a hand operated vibratory compactor such as a BOMAG TM P-9 manufactured by Koehring Company. The compactor 21 further includes a generally flat base plate 25 which lies against the surface to be compacted when the compactor 21 is in use. A front plate 27 is arranged along a forward edge of the flat plate 25. While the front plate 27 is preferably inclined away from the compactor to facilitate a moving of the compactor 21 over obstacles in its path, the front plate could be arranged vertically if so desired. It should be noted that a preferred embodiment of the present invention will be described with reference to a front plate of a compactor. However, many known compactors include an inclined plate along two edges, i.e., front and back edges, to enable bi-directional operation. It is to be understood that the present invention is not limited to a front plate and is equally applicable to any inclined vibratory plate whenever the particular plate may be located in relation to the compactor or the operator.

Typically, the inclined front plate 27 and the flat base plate 25 are formed as a single member. Both the flat plate 25 and the inclined front plate 27 are adapted to be vibrated as a single unit in a known manner by the compactor prime mover to compact or compress soil, asphalt, or other particulate material and also to propel the compactor. Each point on the plates moves in a violent, generally cycloidal path when in operation with the result that density of the material is increased after the compactor has passed.

In a preferred embodiment of an apparatus according to the present invention (see FIG. 2), an elongated water distributing tube 29 is secured, e.g., by welding along a seam 33, to an upper edge of an elongated sheet member 31. In the preferred embodiment, the tube 29 has a rectangular cross-section having a width which is greater than the front plate thickness so that a portion of the lower side of the tube extends in front of the plate 27 to permit liquid to flow along the front plate surface as will be described in more detail below. The member 31, preferably fabricated from steel, has substantially the same length as the tube 29.

The tube 29 and the plate 31 make up an assembly that is releasably secured to an upper portion of the front plate 27, with the lower side of the tube 29 resting on the front plate's upper edge surface and the sheet member 31 extending downwardly from the tube 29. While the assembly of the sheet member 31 and the tube 29 could be secured at any vertical location along the front plate 27, it is preferred to locate the assembly along the upper portion of the plate 27 so that the assembly will be at a height sufficient to avoid damage thereto from contact with solid obstructions, such as curbs, which are often located on or adjacent to the surface being compacted. Also, securement of the assembly is facilitated by resting the flat lower side of the tube against the front plate's upper edge surface.

The assembly is preferably secured to the front plate 27 by a plurality of bolts 35 each of which passes through corresponding aligned bores in both the sheet member 31 and the front plate 27. Each bolt 35 is secured to the front plate 27 by a nut 37 arranged for convenience on a back surface of the front plate 27. When the sheet member 31 is secured to the front plate 27, the member 31 extends across substantially the entire width of the front plate 27 and is operable to disperse liquid over substantially the entire width of the front plate 27 as explained below. The sheet member 31 is generally parallel to the front plate and is maintained space from the surface of the front plate by a plurality of spacer washers 41. Each of the spacer washers 41 is arranged around a corresponding one of the plurality of bolts 35 between the sheet member 31 and the front plate 27.

The sheet member 31 also includes a section 39 along a lower edge that is opposite from the edge where the water distributing tube 29 is secured to the sheet member 31. The section 39 is angled toward the front plate 27 such that an outlet gap 43 of substantially uniform which is formed along the entire length of the sheet member 31 between the front plate 27 and an edge of the angled section 39 when the sheet member 31 is secured to the front plate 27 by the bolts 35 with the spacer washers 41 in place. A suitable sealant 46 is applied between the lower side surface of the tube 29 and the top edge surface of the front plate 27. Since the tube width is greater than the plate thickness, the lower side of the forward portion of the tube remains unsealed. In other words, in an assembled arrangement, the front plate 27, the elongated tube 29 and the sheet member 31 with the angled section 39 together form a container assembly having an interior space 44 which is adjacent the front surface of the front plate 27. The gap 43, when the apparatus is assembled, forms a narrow outlet for the liquid delivered to the interior space 44 and in the preferred embodiment is typically less than ⅛ of an inch and preferably approximately 1/16 of an inch. However, the exact size of the gap is not critical in itself.

A selectively operable shut off valve 48 of any suitable design is connected to the bottom of a liquid storage tank 49. The tank 49 preferably contains water. However, any other suitable liquid could be employed. A connector 45 arranged centrally on an upper surface of the elongated tube 29 provides an inlet for a liquid into the elongated tube 29. A flexible conduit such as a hose 47 establishes a fluid flow path between the liquid storage tank 49 (FIG. 1) arranged on the frame 23 of the vibratory compactor 21 and the connector 45. Since the tank 49 is arranged vertically above the elongated tube 29, the liquid from the tank 49 flows downwardly through the hose 47 and the connector 45 into the elongated tube 29 by gravity. The fluid may also be supplied to the tube 29 by a pressurized system if desired.

After the liquid flows into the elongated tube 29 (FIG. 2), the liquid flows downwardly into an upper portion of the interior space 44 from the tube 29 through a plurality of holes 51 arranged in the forward portion of the tube lower side along substantially the entire length of the elongated tube 29. Each of the holes 51 has a diameter which is less than the tube width and is arranged between the surface of the front plate 27 and the elongated member 31. By arranging the holes 51 along the forward edge of the tube, the liquid fills the tube sufficiently to ensure a substantially continuous liquid flow through the holes 51.

In the preferred embodiment, the holes 51 are unevenly spaced along the length of the tube 29. Specifically, the spacing between adjacent holes 51 (shown in dotted lines in FIG. 1) decreases as the distance from the inlet connector 45 at the center of the elongated tube 29 increases such that a greater number of holes 51 per unit length of the tube 29 are provided near sealed outer ends 52 of the elongated tube 29. In this way, a substantially uniform distribution of liquid along the entire width of the front plate 27 within the interior space 44 of the container assembly is accomplished.

Alternatively, the diameter of each of the holes 51 could increase as the distance from the center of the elongated tube 29 increases. This arrangement would also produce a substantially uniform distribution of liquid from the tube 29 to the interior space 44. However, in order to provide holes of different diameters, separate machining processes would have to be undertaken which operations would lead to a higher cost for the apparatus according to the present invention. Therefore, it is preferred that holes of equal diameter are arranged with gradually decreased spacing between adjacent holes towards the ends 52 of the elongated tube 29, as explained above.

Figure 2:
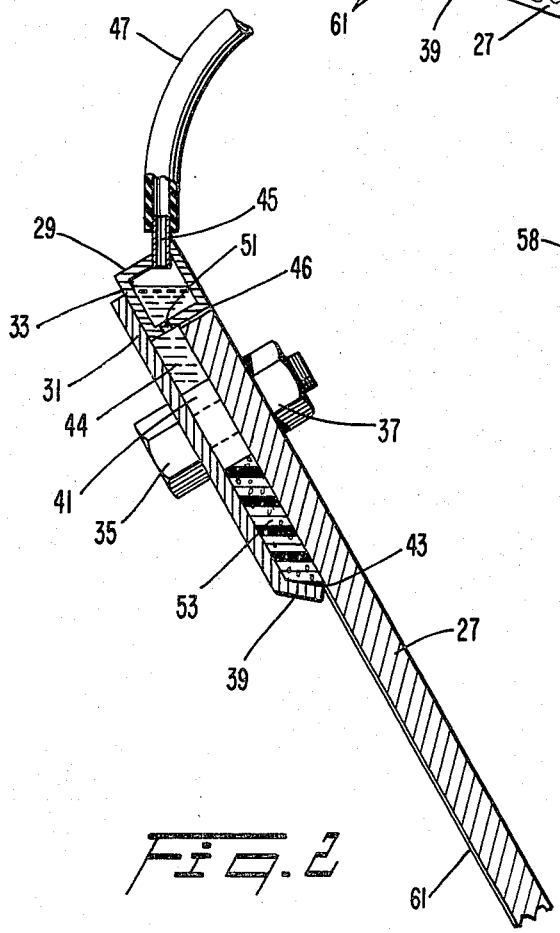
FIG. 2 is a cross-sectional view of a first embodiment of an apparatus according to the present invention attached to the inclined plate of the vibratory compactor.

With further reference to FIG. 2, the preferred embodiment of the present invention includes an element or pad 53 arranged in a lower portion of the interior space 44 along the entire length of the elongated member 31. The element 53 is arranged adjacent the front surface of the front plate 27 and extends downwardly to the gap 43 formed between the angled section 39 of the elongated member 31 and the surface of the front plate 27. Some leakage of the liquid may occur from the ends of the interior space 44. However, such leakage is minimized by placing the outermost holes 51 in the tube 29 at a slight distance from respective ends of the tube 29. Alternatively, the ends of interior space 44 may be sealed by any suitable apparatus.

In the preferred embodiment, the element 53 is comprised of, e.g., a suitable open cell urethane foam rubber. Alternatively, the element 53 could be comprised of a suitable wicking material. One purpose of the element 53 is to maintain intimate contact between a thin film of the liquid which flows downwardly by gravity from the upper portion of the interior space 44 between the element 53 and the front surface of the front plate 27. A further purpose for the element 53 is to reduce the velocity of the flow of liquid sufficiently to assure a very low velocity laminar flow at the outlet gap 43.

It is believed that the very low velocity laminar flow and the thinness of the liquid film, both accomplished by the element 53, act together to assure that liquid flowing through the outlet gap 43 maintains intimate contact with the front plate 27 through the mechanism of surface tension. The limited porosity of the element 53 is effective to retard the liquid flow. The velocity of the liquid flow through the element 53 is so low that a laminar flow is established within a very thin liquid film adjacent the surface of the front plate 27.

After the liquid is discharged from the outlet gap 43, the liquid remains in the form of a sheet for several reasons. First, the thinness of the sheet allows surface tension to maintain the liquid against the plate. Further, the distance from the outlet gap 43 to the flat plate 25 is short and the velocity of the film is low so that the onset of turbulent flow is most unlikely. In the preferred embodiment, the velocity of the liquid flow on the front plate 27 is on the order of one foot per second and the thickness of the film is approximately 0.020 inch with only approximately three inches between the gap 43 and the edge of the flat plate 25. With values of this small magnitude, the liquid flow remains laminar and has the form of a sheet flow as the liquid moves downwardly along the front plate surface.

In the preferred embodiment, when the element 53 and the elongated sheet member 31 are placed against the front surface of the front plate 27, the element 53 is compressed to fit within the interior space 44. The width of space 44 is determined by the spacer washers 41, when the elongated sheet member 31 is secured to the inclined front plate 27 by the bolts 35. The compression of the element 53 assures that only a very thin film of the liquid intimately contacts the surface of the front plate 27 as the liquid moves downwardly along the surface. Also by compressing the element 53, the density of the element is increased to more effectively reduce the velocity of the flow of liquid to assure a laminar flow at the outlet gap 43. The angled section 39 also serves to compress the element 53 particularly along the outlet gap 43. This arrangement further retards the flow at the outlet and ensures that the liquid will be maintained in intimate contact with the plate surface before flowing from the interior space 44.

The length of the element 53 downwardly along the front surface of the front plate 27 must be sufficient to produce the very low velocity laminar flow of the film of liquid. In the preferred embodiment, 50 PPI foam rubber having a downward length of approximately two inches and having a free standing thickness of ½ inch is compressed into the interior space 44 having a thickness of 3/16 inch thick (as determined by the spacer washers 41).

As stated above, it is the distance and time over which intimate contact is maintained between the thin film of the liquid and the surface of the front plate 27 which is most likely controlling. The absorbtive properties of the foam do not appear to be critical in themselves. Nonetheless, the absorptive properties of the foam aid both in maintaining the intimate contact between the thin liquid film and the surface of the front plate 27 and in assuring a very low velocity flow at the outlet 43.

Figure 3:
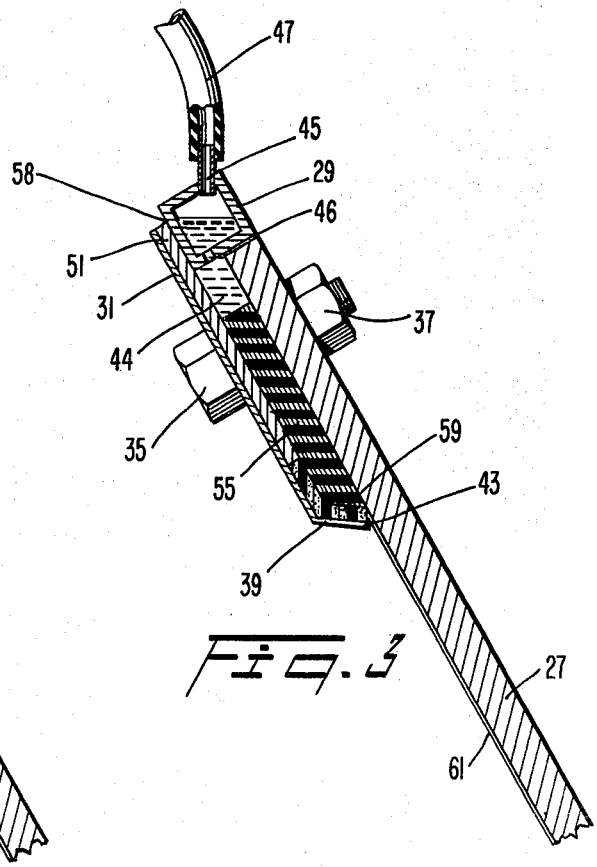
FIG. 3 is a cross-sectional view of a second embodiment of an apparatus according to the present invention attached to the inclined plate of the vibratory compactor.

In a second embodiment of the present invention (FIG. 3), a serrated rubber mat 55 is arranged within the interior space 44 such that the serrations on the mat 55 are positioned adjacent the front surface of the front plate 27 and are oriented perpendicularly to the upper edge of the plate 27. A second elongated sheet member 31 and the tube 29. The tube 29 is secured to the second elongated sheet member 57, preferably by welding, along a seam 58. The elongated sheet member 31 is secured to the second elongated member 57 by the bolts 35.

Arranged along a lower edge of the second sheet member 57 is a first edge of an elongated, angled foam rubber element 59 which is also adjacent the back surface of the elongated sheet member 31 along the angled section 39. A second edge of the angled foam rubber element 59 is adjacent the surface of the front plate 27 along the gap 43.

Due to the serrations in the rubber mat 55, the liquid emanating from the lower edge of the rubber mat 55 tends to form in narrow tubes or channels. By providing the foam element 59 beneath the lower edge of the serrated rubber mat 55 and adjacent the outlet gap 43, these channels are smoothed laterally and the velocity of the flow is decreased to flow the liquid into a continuous thin film or sheet according to the present invention. It should be noted that the elongated sheet member 31 and the second elongated sheet member 57 may be formed as a single unit with a recess provided in a lower section of the unit to receive the foam rubber element 59. However, the single unit construction would require a more extensive machining operation to produce the unit than is required if two separate sheet members are employed as in the illustrated embodiment. Alternatively, the foam rubber element 59 could be arranged beneath only the rubber mat 55 and thereby eliminate the second elongated member 57.

In operation of the preferred embodiment of the present invention, the generally flat plate 25 and the front plate 27 are vibrated in a cycloidal motion as a single unit by the prime mover (not shown). After opening the shut off valve 48, a liquid, preferably water, continuously flows, under the influence of gravity, from the storage tank 49 through the valve 48, the flexible hose 47 and the connector 45 to the elongated tube 29. The liquid is distributed through the plurality of holes 51 in the tube 29 to substantially uniformly fill the upper portion of the interior space 44 above the element 53.

The liquid supplied to the interior space 44 of the container assembly slowly seeps downwardly by gravity between the surface of the front plate 27 and the element 53. During this time, intimate contact between a thin film of the downwardly flowing liquid, which film is between the element 53 and the lower surface of the front plate 27, is maintained over a predetermined minimum distance which is sufficient to produce a low velocity laminar flow such that the thin liquid film remains in the form of a sheet after flowing out from the interior space 44.

As the liquid flows further downwardly between the element 53 and the surface of the front plate 27, the liquid reaches the lower portion of the interior space 44 and flows through the outlet gap 43. As seen in FIG. 1, the water emanates from the gap 43 along substantially the entire width of the front plate 27 in the form of a sheet or a plurality of waves 61 which move downwardly along the front plate surface. The wave action is a consequence of the thin layer of liquid and indicates that laminar flow is present.

In the second embodiment (FIG. 3), the operation is essentially the same as that for the preferred embodiment except that intimate contact is maintained between the front plate surface and the serated rubber mat 55 for a distance sufficient to produce the low velocity laminar flow. The laminar liquid flow is then smoothed laterally by the foam rubber element 59 before flowing from the interior space 44.

The liquid is maintained in the form of a sheet primarily by surface tension. Even with the violent movement of the vibratory plates 25, 27 of the vibratory compactor 21, the liquid sheet remains in contact with the surface of the front plate 27. Moreover, the sheet flow is maintained despite the fact that the vibratory action generates very high accelerations, on the order of approximately ±50 g rms with peaks up to 320 g.

The waves 61 (see FIG. 1) in the liquid sheet produced on the front plate surface move downwardly to a lower edge of the front plate 27 which joins the forward edge of the generally flat vibratory plate 25. The liquid maintains contact with the front plate and almost turns the corner onto the flat plate 25. In this way, liquid is deposited where it is most urgently needed, i.e., along the forward edge of the flat vibrating plate 25, to effectively prevent material from sticking to the plates 25, 27. Because the liquid is not flung onto the material being compacted ahead of the flat plate 25, but rather reaches the material at substantially the same time as the flat plate 25, evaporation of the liquid as the liquid hits a hot material, e.g., asphalt, does not occur. In other words, the liquid is applied directly to the vibratory plates 25, 27 to prevent sticking of the hot material to the surface of the plates 25, 27.

In the preferred embodiment, the surface of the front plate 27 may be roughened and/or made porous in order to increase the surface area and thereby provide an increase in the adhesion of the liquid to the plate surface through the mechanism of surface tension. In practice, it has been found that ordinary rusting of the front plate 27, which typically occurs after operating the vibratory compactor 21 for a period of time, functions satisfactorily to increase the microscopic surface area and porosity of the front plate 27 and improve the ability of the liquid to adhere to the surface of the front plate 27 and thereby reach the generally flat vibratory plate 25. Due to the very low velocity flow of the plate 27 is not sufficient to induce turbulent flow in the liquid.

The principles and preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. An apparatus for applying a thin film of liquid to a vibratory plate arranged on an edge of a vibratory compactor comprising:

container means fixed to the plate for holding a liquid adjacent to the plate;

inlet means for admitting the liquid to the container means;

means for maintaining intimate contact between a thin film of the liquid and a front surface of the vibratory plate over substantially an entire width of the plate as the thin film moves downwardly under the influence of gravity, said means for maintaining intimate contact being arranged within the container means, the means for maintaining intimate contact comprising a serrated rubber mat arranged adjacent the surface of the plate and open cell urethane foam rubber arranged within the container means at an edge of the serrated rubber mat adjacent to both the plate and the outlet means; and outlet means arranged along substantially the entire width of the plate for permitting a low velocity laminar flow of a thin liquid film to emanate from the container means along the surface of the plate in the form of a liquid sheet which remains in contact with the plate surface due primarily to surface tension as the sheet moves downwardly.

* * * * *